United States Patent [19]

Birkenfeld et al.

[11] 4,060,957

[45] Dec. 6, 1977

[54] METHOD AND APPARATUS FOR FORMING PALLETLESS PACKAGES

[75] Inventors: Richard Birkenfeld, Beckum; Reinhold Jaschke, Ahlen, both of Germany

[73] Assignee: Firma E. Möllers, Beckum, Germany

[21] Appl. No.: 780,810

[22] Filed: Mar. 24, 1977

[30] Foreign Application Priority Data

| | | |
|---|---|---|
| Apr. 3, 1976 | Germany | 2614558 |
| Jan. 22, 1977 | Germany | 2702613 |

[51] Int. Cl.[2] ..... B65B 55/06; B65B 35/50

[52] U.S. Cl. ..... 53/26; 53/27; 53/30 S; 53/159; 53/170; 53/184 S

[58] Field of Search ..... 53/26, 27, 30 S, 159, 53/161, 170, 176, 183, 184 S, 392; 206/386, 497

[56] References Cited

U.S. PATENT DOCUMENTS

| | | | |
|---|---|---|---|
| 2,157,642 | 5/1939 | Vosler | 53/392 X |
| 3,103,773 | 9/1963 | Barzano | 53/392 |
| 3,788,462 | 1/1974 | Meincer | 53/30 S |
| 3,853,218 | 12/1974 | Grasvoll | 53/30 S |
| 3,896,604 | 7/1975 | Marantz | 53/176 |
| 3,903,673 | 9/1975 | Grasvoll | 53/184 S |
| 3,995,410 | 12/1976 | Berghgracht | 53/159 |

*Primary Examiner*—Robert Louis Spruill

*Attorney, Agent, or Firm*—Toren, McGeady and Stanger

[57] ABSTRACT

A method and apparatus for forming a palletless package having a plurality of layers of objects, the bottom layer of which is formed with cavities to receive the fork arms of a lift truck. A stack of the objects to be packaged is first formed in a palleting device by placing the objects in a plurality of layers each having the same base area. Then, an additional layer of objects is placed on top of the stack in such a way that at least two recessed cavities are formed on opposite sides of the additional layer. A first shrink-on foil bonnet is then pulled over the top of the completed stack in a bonnet pullover device and the stack is transported to a first shrinking furnace where the first bonnet is heat shrunk onto the stack. The stack is then transported to a turnover device where it is rotated 180° so that the additional layer and the recessed cavities are repositioned to the bottom of the stack. The turned over stack is then transported to a second bonnet pullover device where a second shrink-on foil bonnet is pulled over the completed stack covering the end opposite the additional layer. The stack is then transported to an addtional shrinking furnace where the second bonnet is heat shrunk onto the completed stack and so that overlapping areas of the first and second shrink-on bonnets were welded together. Conveyor means are used for transporting the stack between the various operating devices.

22 Claims, 5 Drawing Figures

METHOD AND APPARATUS FOR FORMING PALLETLESS PACKAGES

BACKGROUND OF THE INVENTION

The invention relates generally to the art of packaging, and more particularly to a method and apparatus for packaging objects arranged in a plurality of stacked layers and wrapped in a heat shrunk plastic foil, the bottom of the package having a layer arranged in such a way that two elongated cavities are provided for receiving the fork arms of a lift truck.

A variety of methods and devices are known to cover a stack with a shrink-on foil or to wrap a stack with two shrink-on foil bands looped about the stack perpendicularly to each other. Previously elaborate means have been required for wrapping a foil about a special layer of the stack to produce a self supporting package and at the same time to cover the entire stack for protecting all of its sides, note German DOS 18 04 032, 23 03 127, 23 03 128 and 23 07 106.

Accordingly, it is the object of the present invention to provide a solution to the problem of forming a stable palletless package of the type having means for receiving the fork arms of a lift truck, which at the same time is completely wrapped and protected against weather conditions, in a simple manner and in a manner which is capable of high production rates.

SUMMARY OF THE INVENTION

The objective of the invention is accomplished by providing a method of packaging a plurality of objects which are stacked in layers in a palletless plastic foil package having a bottom layer formed with cavities to receive the fork arms of a lift truck, comprising the following steps: stacking the objects to be packaged into a plurality of layers each of which has the same base area, and placing an additional layer of objects onto the top surface of the stack, the additional layer having a base area different from the base area of the plurality of layers so as to form two elongated recessed cavities formed on opposite sides of the additional layer at the top of the stack. Then, a first shrink-on foil bonnet is pulled over the top of the completed stack thus covering the additional layer. The first shrink-on bonnet is heat shrunk onto the stack, and then the stack is rotated 180° so that the additional layer placed on top is now repositioned to the bottom of the stack with the recessed cavities located at the bottom for receiving the fork arms of a lift truck. Then, a second shrink-on foil bonnet is pulled over the completed stack covering the other end of the stack so as to overlap with the first shrink-on foil bonnet, and then the second shrink-on bonnet is heat shrunk onto the completed stack thus welding the first and second bonnets together at areas of overlap.

It has been found that the foregoing procedure results in a very simple and practically problem free formation of a palletless package having the peculiar advantage that the finished package is completely protected against external influences such as weather conditions, by the two shrink-on foil bonnets having been pulled over the stack in opposite directions. Thus, even packages having relatively sensitive and perishable objects can be readily stacked out of doors for prolonged periods of time. This is particularly useful for packaging such perishable items as cement bags which require outside storage and shipping to such areas as developing countries.

In order to further increase the stability of the package in the area of the recessed cavities, and to provide very defined cavities, an additional plastic foil is placed over the stack prior to placing the additional layers of objects on the top of the stack with the ends of the additional plastic foil overhanging the stack so that the overhanging regions of the additional plastic foil not covered by the additional layers of objects are welded with the first shrink-on foil bonnet when it is heat shrunk onto the stack.

When the first shrink-on foil bonnet is shrunk onto the stack it can be conformed to the elongated recessed cavities formed by placing the additional layer of objects on the stack using an additional plastic foil whose surfaces will come into contact with the first shrink-on bonnet so as to be welded together with it.

It has been found, however, particularly when such an additional plastic foil is not used, that it is of advantage to conform the shrink-on bonnet to the recessed areas during the shrinking operation, i.e. while the stack is in the shrinking furnace. It may be advisable to perform a further operation on the stack to further insure that the bonnet is conformed to the recesses after the shrinking operation and during the cooling of the shrink-on bonnet. Alternatively, the shrink-on bonnet may be conformed to the recesses during the cooling operation instead of during the heat shrinking operation.

Finally, it was found to be of particular advantage to conform the first shrink-on foil bonnet, and any overlapping parts of the second shrink-on foil bonnet into the recessed cavities formed by the additional layer of objects on the stack, after the shrinking operation and during the cooling of the second shrink-on foil bonnet. In this manner, duplicate steps of conforming the foil to the recessed cavities can be eliminated. This conforming operation can take place subsequent to the conforming operation described above, however, it may be sufficient, depending upon the thickness and the material used as the shrink-on foil to effect only this last mentioned conforming operation after the shrinking and during the cooling of the second shrink on plastic foil.

It was also found to be of particular advantage to perform this last mentioned conforming operation, in order to conform the shrink-on plastic bonnet into the recessed cavities, by lowering the stack in the range of the additional layer by a distance equal to the height of the additional layer onto stationary supports which will engage both the vertical and horizontal surfaces of the recesses so that the plastic foil will be pressed into position. Accordingly, only stationary supports conforming to the recessed cavities need be provided for this purpose.

Further, it has been found useful to strengthen the packaged stack by inserting a supporting foil of suitable material, for example of plastic or cardboard, between the lowermost layer of the stack and the second lowermost layer thereof during the formation of the stack. Further advantages are achieved if the supporting sheet is bonded, pasted or otherwise welded on both sides thereof to the objects in the stack on opposite sides. This can be accomplished without significant costs within the framework of an ordinary automatic palleting machine.

A further feature of the invention is to apply an additional foil layer or a further shrink-on foil on top of or in addition to the first shrink-on foil bonnet, which is preferably of the same material as the shrink-on foil bonnet. This can be done after the formation of the stack which would include the placing of the additional layer on the top of the stack and before the first shrink-on foil bonnet is applied to the stack. It is preferable to provide that the additional foil layer has opposite ends which extend over the recessed cavities and onto the horizontal surfaces of the cavities. The use of this additional foil layer is particularly recommended when packaging very heavy objects whereby the additional layer of objects is supported by a double plastic layer so that the objects contained in the additional layer will not break through the plastic cover when fork arms of a lift truck are inserted in the recessed cavities for lifting the entire stack.

Finally, it has been found advisable to make the cross seam of the first shrink-on foil bonnet extend perpendicularly to the recessed cavities formed by the additional layer, when the first shrink-on foil bonnet is pulled onto the stack. In this manner, the triangular wedges of the bonnet formed when the upper end of the shrink-on foil bonnet is pulled onto the stack will fall into the recessed cavities to provide additional reinforcement.

An arrangement of operating devices found suitable for carrying out the method according to the invention includes a palleting device for stacking the objects to be packed, a first bonnet pullover device located downstream from the palleting device for pulling a first shrink-on foil over the stack, a shrinking furnace located downstream from the first bonnet pullover device for heat shrinking the first foil bonnet onto the stack, a turnover device located downstream from the shrinking furnace for turning the stack over so that the recesses are located on the bottom of the stack, a second bonnet pullover device located downstream from the turnover device for pulling a second foil bonnet onto the stack from the opposite end, and a further shrinking furnace located downstream from the second bonnet pullover device for heat shrinking the second foil bonnet onto the stack. A conveyor means is provided to extend through each of the foregoing operating devices for transporting the stack through each of these devices and for moving the stack from one device to the next.

Instead of providing two bonnet pullover devices and two shrinking furnaces with a turnover device arranged between the first shrinking furnace and the second pullover device, a turnover device can be arranged between a bonnet pullover device and a shrinking furnace in order to simplify the entire arrangement. In this case, the turnover device is simply traversed by the stack without turning after the application of the first shrink-on foil bonnet which is then shrunk-on in the shrinking furnace, after which the stack returns to the turnover device, is there turned over, and moves back into the bonnet pullover device in order to apply the second shrink-on plastic bonnet. As will be appreciated, this will result in a simplified arrangement of operating devices utilizing a circular track with appropriate switching devices to provide transportation of the stack to and from the only bonnet pullover device.

With the exception of the novel turnover device provided for herein, standard operating devices may be used in the present arrangement, such as palleting devices, bonnet pullover devices and shrinking devices, which have been well known in the art for covering stacks of objects arranged on pallets. The present invention, however, provides that these various well known operating devices can be arranged in the manner provided herein with appropriate conveyor means extending through each of the devices.

It has been found particularly advantageous to design the conveyor means in the form of a belt conveyor with conveyor rollers directly adjoining each other. This insures high operating capacity on one hand and reliable and gentle transportation of the stacks even without a supporting pallet, on the other hand.

A very simple and advantageous design of the turnover device is obtained if it is provided with upper and lower conveyor surfaces for supporting the stack, with both surfaces being movable from opposite directions toward a stack resting on the bottom conveyor surface. Means are provided for rotating both the upper and lower conveyor surfaces about a substantially central axle to effect rotation of the stack and means are provided for subsequently moving the upper and lower conveyor surfaces away from the stack in such a way that the conveyor surface which is then located at the bottom will be in the same position as the bottom conveyor occupied prior to the turnover operation.

The conveyor surfaces may be formed by endless belts and can be carried on a first set of vertical guide rails which are movably carried in a second set of vertical guide rails which in turn are supported on bearing plates located on opposite sides of the horizontal axis about which said conveyor surfaces are to be rotated.

Bearing plates may also be provided in the turnover device for supporting the stack during rotation.

A further feature of the invention is to provide an additional operating device carrying pressing tools for engaging the shrink-on bonnet to press the bonnet into conformity with the shape of the elongated recessed cavities. This additional operating device is preferably arranged in a position subsequent to the shrinking furnace so that this operation will be carried out during the cooling of the foil. It has been found desirable to use two Z-shaped pressure bars mounted for pivotal movement on a vertically adjustable and pivotally mounted beam for the pressing tools.

Additionally, it has been found desirable to provide a further operating device for conforming the first shrink-on foil bonnet, and any overlapping areas of the second shrink-on foil bonnet into the recessed cavities after the stack has been turned and the cavities are located on the bottom.

BRIEF DESCRIPTION OF THE DRAWINGS

The invention will be described more fully hereinafter in connection with the following drawings in which.

DESCRIPTION OF THE INVENTION

Figure 1:
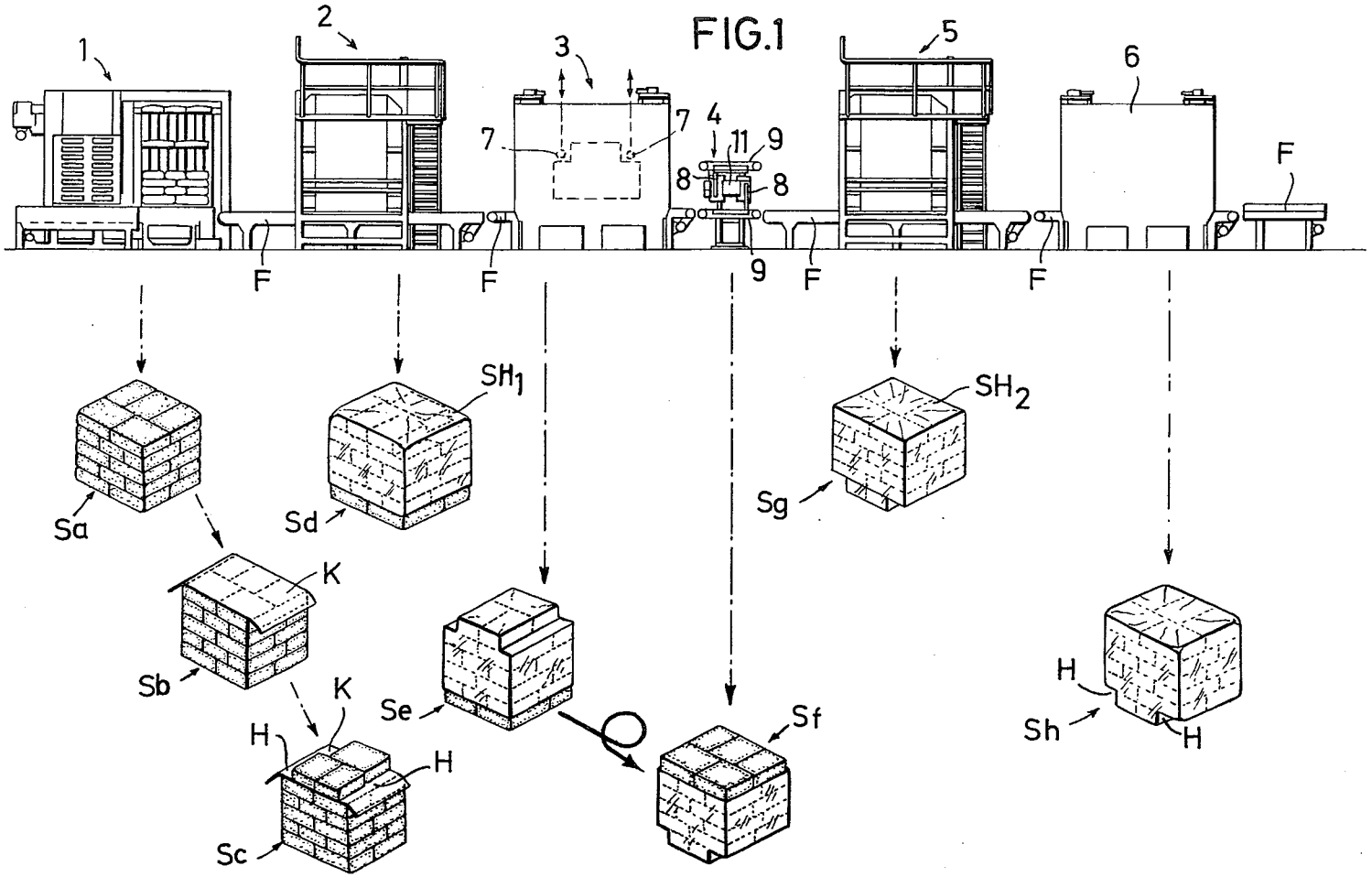
FIG. 1 is a side elevational view schematically showing the arrangement of the various operating devices according to the present invention for forming the package according to the steps of the invention, and showing in perspective view the various stages of forming the package after each of the operating steps.

Referring now to FIG. 1 of the drawings, the entire arrangement of the various operating devices of the invention is shown and includes: a palleting device 1, a first bonnet pullover device 2, a first shrinking furnace 3, a turnover device 4, a second bonnet pullover device 5, and a second shrinking furnace 6. A conveyor means generally indicated as F, includes individual conveyor belts which extend through each of the individual operating devices and are arranged at the same level or height. The individual conveyor belts each have adjoining conveyor or transportation rollers whereby the palletless package may be transported from one conveyor belt to the next so that it may pass through each of the individual operating devices.

The various stages of forming the palletless package are illustrated in FIG. 1 by schematically representing the various operating devices and the arrangement of the package provided after each operating device has performed its functon. The operation of the various operating devices to form the completed package will now be described in more detail in connection with FIG. 1.

Objects, such as for example bags, to be wrapped in the plastic foil and formed into the package are stacked in the palleting device 1 into a number of layers in a common cross pattern, such as illustrated in the stage indicated by S*a* shown in FIG. 1. As can be seen, each of the layers has substantially the same base area so as to form a uniform, but incomplete, stack having a first or top surface and a second or bottom surface.

While the stack is still within the palleting device, a plastic foil K may be placed over the first or top surface of the stack and is allowed to overhang the sides of the stack. This phase of the packaging operation is shown as stage S*b*. Next, an additional layer of objects, which is narrower than the other layers of the stack, is placed on top of the plastic foil K in such a way that elongated recessed cavities H are formed on two opposite sides of the additional layer. This stage can be seen at S*c* in FIG. 1. The stacking operation is now complete so that the stack may be conveyed out of the palleting device.

The completed stack, with the additional layer of objects on the top, formed in the palleting device has been formed while resting on the conveyor means F so that it may be transported therefrom into the first bonnet pullover device 2. In the bonnet pullover device 2, a first shrink-on foil bonnet SH 1 is pulled over the top of the stack covering the additional layer which had been placed on the top of the stack and is drawn down almost to the bottom of the stack as is illustrated in the package forming stage S*d* of FIG. 1.

The covered stack is then moved by the conveyor means F into the first shrinking furnace 3 and the bonnet SH 1 is heat shrunk tightly onto the stack. Two horizontally arranged pressure bars 7 are movably carried within the first shrinking furnace 3 so that it may be moved up and down by means of operating bars extending through the roof of the shrinking furnace, until they come into contact with the top side of the covered stack in the areas of the recessed cavities located at the two opposite lateral edges, as indicated in broken lines in FIG. 1. The horizontal pressure bars 7 are pressed firmly down into the cavities H of the stack so that the bonnet SH 1 is pressed firmly against the opposed areas of the plastic foil K in such a way that a good thermoplastic bond between these two foils is obtained. Further, the bonnet simultaneously contoured so as to conform to the recessed cavities H thus producing the packaging forming stage S*e*. Accordingly, the use of the pressure bars 7 simultaneously operates to press the bonnet SH 1 into the recessed cavities H and to simultaneously insure that the plastic foil of the bonnet is thermoplastically bonded to the foil K in the area of the recessed cavities.

Figure 3:
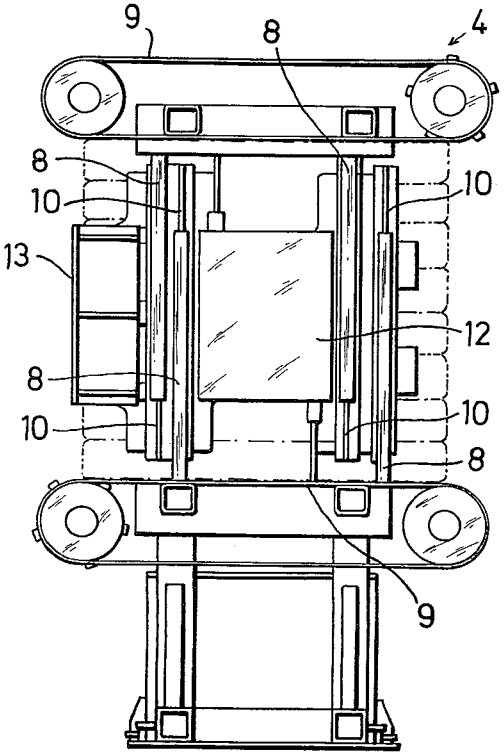
FIG. 3 is an end elevational view of the turnover device shown in FIG. 2.
Figure 2:
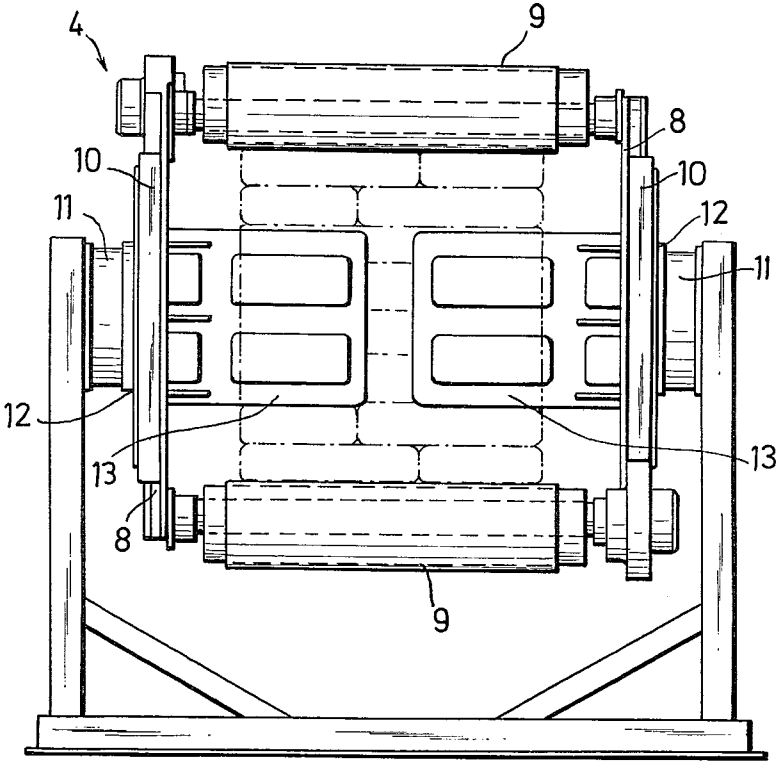
FIG. 2 is an enlarged side elevational view of the turnover device according to the present invention.

Subsequently, the stack is transported by conveyor means F into the turnover device 4 and is here rotated by 180° into the position shown by the package forming stage S*f*. With reference to FIGS. 2 and 3 of the accompanying drawings, the turnover device, generally designated by reference numeral 4, is provided with bearing blocks on both sides of a horizontal two part rotary shaft 11 and has bearing plates 12 on the inner ends thereof. Vertical guide rails 10 are secured to the bearing plates 12. Vertical guide rails 8 may be moved along the guide rails 10 by means of a control mechanism, such a hydraulic press, not shown herein. Guide rails 8 each carry upper and lower conveyor belts 9 with the lower belt 9 forming a part of the conveyor means F. Supporting plates 13 are secured on one side of the bearing plates 12 and serve to support the stack which is carried on the conveyor means F and placed between the conveyor belts 9.

At a point in the operation when the stack has come to rest in the center of the lower conveyor belt 9, the two conveyor belts 9 may be moved in opposite directions toward each other by means of the control mechanism not shown, so that the stack may be retained between the two conveyor belts 9. Thereafter, the conveyor belts 9 may be turned or rotated with the stack about the horizontal rotary shaft 11 by means of a further control mechanism also not shown herein. After the stack has been rotated, the conveyor belts 9 may be moved slightly apart in such a way that the conveyor belt which is now located at the bottom will be aligned with the level of the conveyor means F in the same position which the conveyor belt now located at the top occupied prior to the turnover operation.

From the turnover device 4, the stack will be transported on the conveyor means F to the second bonnet pullover device 5 where it will be covered with a second shrink-on plastic foil bonnet SH 2, as shown in the package forming stage S*g*.

Subsequently, the stack is again moved by the conveyor means F into the second shrinking furnace 6 where the second bonnet SH 2 is tightly heat shrunk onto the stack, welding the overlapping lateral regions of the bonnets SH 1 and SH 2 with each other, as shown in the package forming stage S*h* illustrated in FIG. 1

The palletless package is now finished and completely wrapped leaving two recessed cavities at the bottom thereof to be engaged by the fork arms of a lift truck and the package can then be transported from the second shrinking furnace 6 and removed by adjoining tracks of the conveyor means F.

The finished package can then be lifted from the last part of the conveyor means F by the fork arms of a lift truck with the arms engaging the cavities H.

It has been found that inherent stability is achieved by the above described packaging and particularly as a result of bonding the first foil bonnet SH 1 with the plastic foil K in the areas of the cavities H, so that when the finished package is lifted by the fork arms of a lift truck, the package will hold together in the area not directly supported by the arms. Further, it can be seen that all of the covered objects are well protected on all sides against any external influences, such as weather conditions. This is a result of the fact that the two separate plastic foil bonnets SH 1 and SH 2 have been pulled over the stack of objects in two opposite directions to insure complete covering.

Figure 4:
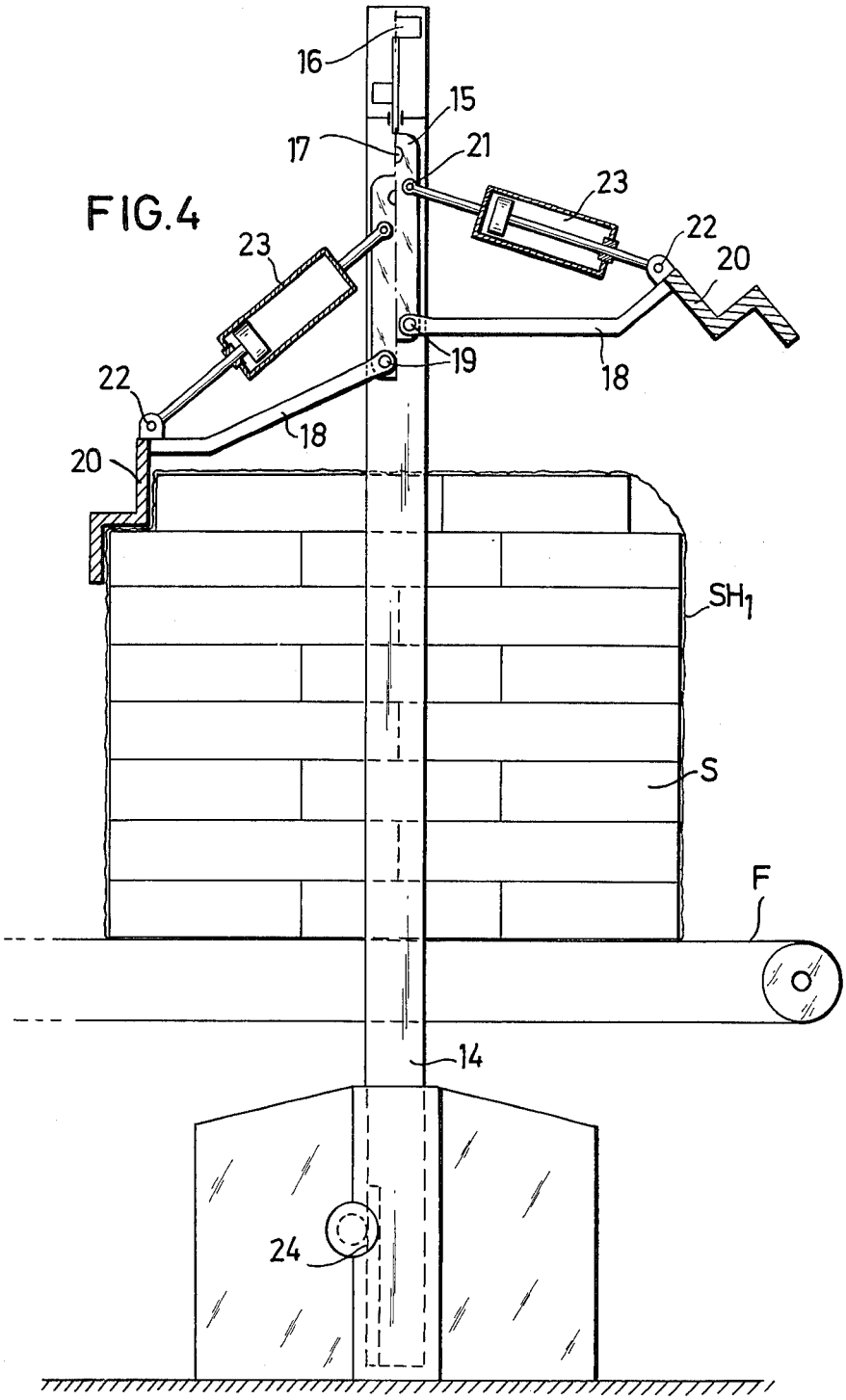
FIG. 4 is a side elevational view of means in accordance with the present invention for conforming the first shrink-on plastic foil bonnet into the recessed cavities of the stack formed by the additional layer, after the first shrink-on bonnet has been heat shrunk onto the stack and while it is cooling.

Referring now to FIG. 4, an operating device is shown for pressing the shrink-on foil SH 1 in the areas of the recessed cavities H of the stack after the stack has left a shrinking furnace and while the foil is cooling, so that the foil may be wrapped tightly about all of the objects in the stack and so that it will conform to the cavities. This operating device includes a frame with frame posts 14 arranged on opposite sides of the conveyor means F which carries a stack S from the shrinking furnace with a shrunk on foil bonnet SH 1 pulled over the top of the stack and covering the additional layer of objects which have been placed on the top of the stack. A cross beam 15 is carried between the posts 14 and is supported in a manner so that it may be moved up and down on the posts by means of a hydraulic press 16 which is arranged stationary on each of the posts 14. Beam 15 is pivotally mounted about a horizontal axle 17 which is positioned at the upper end of the beam and which can be moved in a vertical direction along the posts 14 by means of the hydraulic presses 16. Two levers 18 are pivotally connected at one end thereof to the lower portion of each side of beam 15 at 19. The other end of each of the levers 18 carries a Z-shaped pressure bar 20. A hydraulic press 23 is pivotally supported at one end to the beam 15 at 21 and has an extendable piston pivotally connected at 22 to each of the pressure bars carried on the end of the levers 18.

As a result of controlling the operation of the hydraulic presses 23, the pressure bars 20 can be pivoted from an inoperative position (shown on the right side of FIG. 4) into an operative position (shown on the left side of FIG 4) in which the Z-shaped pressure bar 20 will engage the foil SH 1 and press it into the recessed cavities of the stack. A small vertical movement of the pressure bars 20 may be effected to smooth the foil bonnet SH 1 into the recessed cavities of the upper portion of the stack S as can be seen in the left side of FIG. 4. The pivotal mounting of beam 15 allows automatic adjustment of the pressure bar 20 when the stack S is not exactly positioned in the center of this operating device between the frame posts 14.

The frame posts 14 may also be adjustable in the vertical direction by rack and pinion gears 24 so that the entire operating device may be adapted to stacks having different heights.

The operating device in FIG. 4 may be arranged in a position subsequent to the shrinking furnace 3 and before the turnover device 4 so that the pressure bars may operate on the shrinking foil to press it into shape with the recessed cavities while the recessed cavities are still located on the top of the stack.

Figure 5:
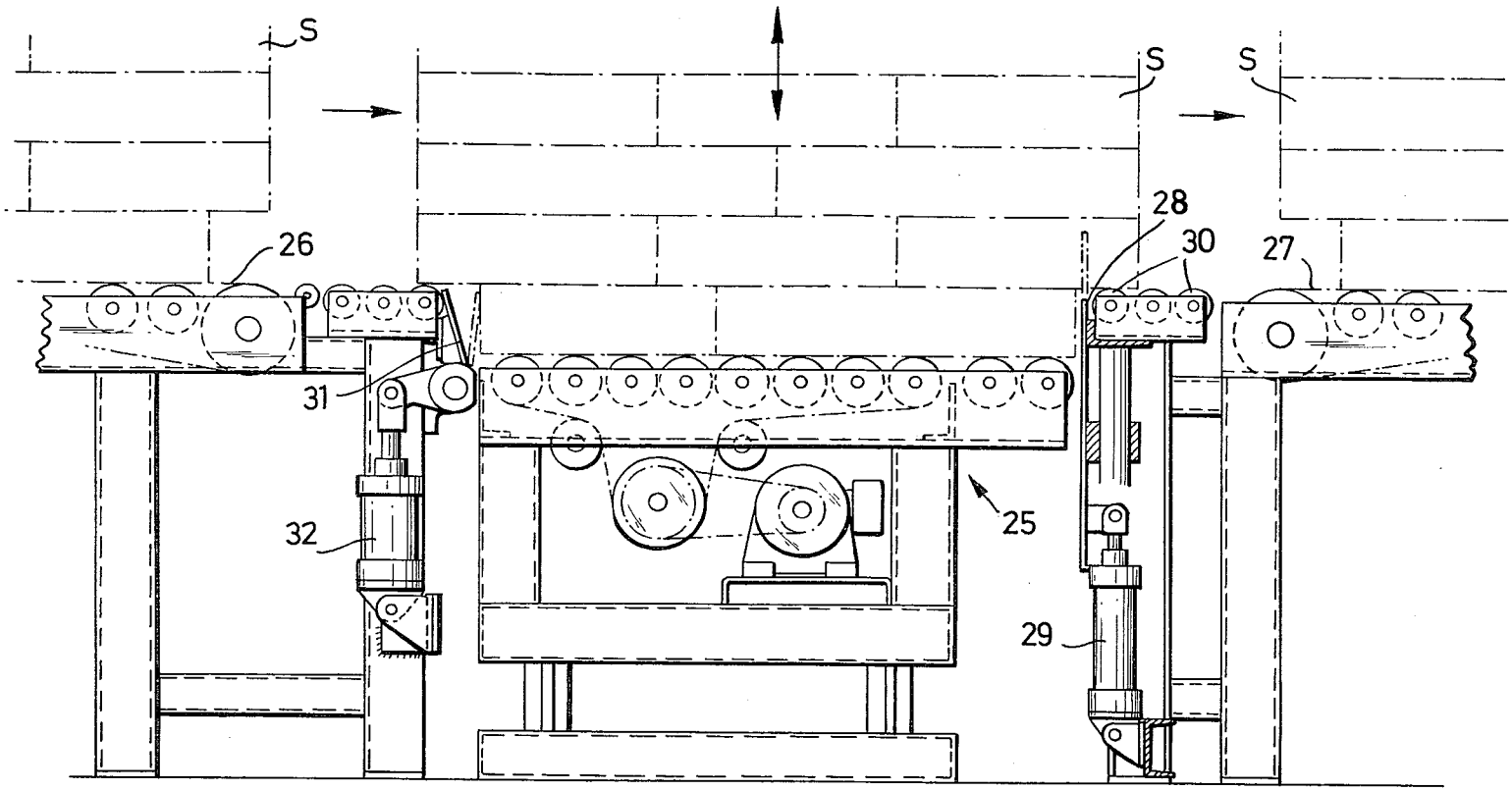
FIG. 5 is a side elevational view of means for conforming the shrink-on plastic foil bonnets into the recessed cavities of the stack when the recessed cavities are located at the bottom of the stack and after the shrink-on foils have been heat shrunk onto the stack and have left the shrinking furnace.

Referring now to FIG. 5, a further operating device is shown which may be positioned downstream from the shrinking furnace 6 for operating on the stack after the second shrink-on foil SH 2 has been pulled over the stack after it has been turned over, heat shrunk onto the stack and while cooking.

The operating device shown in FIG. 5 includes a conveyor indicated generally by reference numeral 25 which is positioned between a conveyor 26 transporting a stack S from a shrinking furnace, and a conveyor 27 for transporting the stack S to a further operating station or a pickup point after the operating device shown in FIG. 5 performs the function of the stack S to be described hereinbelow.

The conveyor 25 is shown in FIG. 5 in a lowered position for operating on the stack S. Means, such as lifting gears (not shown herein) are provided for adjustably raising the conveyor 25 to positions between that shown in FIG. 5 and a position in which the surface of conveyor 25 is aligned with the surfaces of the adjoining conveyors 26 and 27.

A stop bar 28 mounted for vertical movement is positioned at the front end (with respect to the direction of conveying) of the conveyor 25. The stop bar 28 extends in a direction transverse to the conveying direction of the stack S. When a stack S is conveyed onto the conveyor 25 the stop bar 28 will first be in its raised position (as shown in dash dot lines in FIG. 5) and is then slightly lowered below the normal conveying plane when the additional layer of objects (now located at the bottom of the stack) strikes against the stop bar 28 so that the stop bar will be in the position shown in solid lines. The lowering movement of the stop bar 28 is effected by means of the hydraulic press 29 connected to the conveyor 27. Positioned adjacent to the stop bar 28 are a plurality of stationary idling rollers 30 for engaging the horizontal surface of the recessed cavity on the right side of the stack S on the conveyor 25. The combination of the idler rollers 30 operating on the horizontal surface of the recessed cavity and the stop bar 28 engaging the vertical surface of the recessed cavity serves to sharply define the recessed cavity and to cause any overlapping plastic foil to be pressed into the cavity so as to conform to its shape.

A pressure plate 31, located on the trailing side of the conveyor 25 (with respect to the direction of conveying of a stack) is mounted for pivotal movement about its lower edge. Hydraulic press 32 is linked with the pressure plate 31 so as to cause pivotal movement of the plate between the positions shown in broken line and in solid line. When the hydraulic press 32 is operated so as to cause the pressure plate 31 to pivot in a clockwise direction, the pressure plate will move into the position shown in broken lines for engaging the vertical surface of the recessed cavity shown on the left side of FIG. 5.

In operation, a stack S having both bonnets SH 1 and SH 2 shrunk onto the stack will be transported along conveyor 26 onto conveyor 25 which will be in its raised position until the lower or additional layer of the stack strikes against the raised stop bar 28, after which the conveyor will be lowered into the position shown in FIG. 5 at which point the drive for conveyor 25 will be turned off so as to cease the conveying operation. Stop bar 28 will then be lowered into the position shown in solid lines. Finally, pressure plate 31 will be pivoted toward the additional layer of the stack resting on the conveyor 25 in such a way so that the plastic foil in the recessed cavity areas will be smoothly pressed into the recessed cavities so as to conform to their shape.

The operating elements of this device will remain in the operative position until the cooling process for the shrink-on foil bonnets has sufficiently progressed to insure that the foil bonnets will remain in the recessed cavity areas after the conveyor 25 has been lifted and after the pressure plate 31 has been removed from its operative position.

After sufficient cooling, the pressure plate 31 will be pivoted in a counterclockwise direction into the solid line position, the conveyor 25 will be raised and operated so that the stack S may be conveyed onto the conveyor 27.

As will be appreciated, the above described embodiment may be modified in a variety of ways without departing from the spirit and scope of the invention. Accordingly, the thickness of the plastic foils used to complete the package may have an appropriate weight to the objects being covered. Also, it may be of advantage to use a heavier foil bonnet to cover the stack from the end having the additional layer than the foil bonnet to be shrunk on from the opposite side. This will serve to firmly hold the bottom layer of objects in position between the cavities for engagement by fork arms of a lift truck.

While the invention has been described and illustrated with respect to certain embodiments which produce satisfactory results, it will be appreciated by those skilled in the art, after understanding the purposes of the invention that various additional changes and modifications may be made without departing from the spirit and scope of the invention, and it is therefore intended in the appended claims to cover all such changes and modifications.

What is claimed is:

1. A method of packaging objects in a palletless plastic foil package having cavities formed therein to receive fork arms of a lift truck, comprising the steps of stacking objects to be packaged into a plurality of layers each having the same base area and forming a stack having first and second end surfaces, placing an additional layer of objects to be packaged onto the first surface of said stack and having a base area different from the base area of said plurality of layers so that at least two recessed cavities are formed on opposite sides of said additional layer for receiving said fork arms and thus forming a completed stack, pulling a first shrink-on foil bonnet over the top of said completed stack covering said additional layer, shrinking said first bonnet onto said completed stack by application of heat, rotating said completed stack 180° so that said additional layer is repositioned to the bottom of said completed stack, pulling a second shrink-on foil bonnet over the completed stack covering said second end surface of said stack and overlapping with said first shrink-on foil bonnet, shrinking said second bonnet onto said completed stack and welding said first and second bonnets together at areas of overlap by the application of heat.

2. The method according to claim 1 comprising the additional step of hanging a plastic foil over said stack covering said first end surface of said stack prior to placing said additional layer of objects onto said first end surface, overhanging regions of said plastic foil not covered by said additional layer of objects being welded with said first shrink-on foil bonnet when said first shrink-on foil bonnet is shrunk onto said completed stack.

3. The method according to claim 1 comprising the further step of conforming said first shrink-on foil bonnet into the recessed cavities formed by said additional layer while said first shrink-on foil bonnet is being shrunk onto the completed stack.

4. The method according to claim 1 comprising the further step of conforming said first shrink-on foil bonnet into the recessed cavities formed by said additional layer after said first shrink-on foil bonnet has been shrunk onto said completed stack and while said first shrink-on foil bonnet is cooling.

5. The method according to claim 1 comprising the further step of conforming overlapping areas of said second shrink-on foil bonnet into said recessed cavities formed by said additional layer after said second shrink-on foil bonnet has been shrunk onto the completed stack and while it is cooling.

6. The method according to claim 5 wherein the step of conforming the overlapping parts of said second shrink-on foil bonnet into said recessed cavities comprises lowering said completed stack onto stationary supports for engaging said recessed cavities and pressing said foil onto the vertical and horizontal surfaces thereof.

7. The method according to claim 1 further comprising the step of inserting a supporting foil between the lowermost layer and the second lowermost layer of said plurality of layers during the formation of said stack.

8. The method according to claim 7 wherein said supporting foil is welded on both sides thereof with oppositely positioned objects being packaged.

9. The method according to claim 1 further comprising the step of applying a foil layer of the same material as said first and second shrink-on foils over said additional layer prior to pulling said first shrink-on foil bonnet onto said completed stack so that opposite ends of said foil layer extend over said recessed cavities formed by said additional layer and onto lateral regions of the exposed surfaces of said first end surface of said stack.

10. The method according to claim 1 wherein said first shrink-on foil bonnet is pulled over said completed stack so that the cross seam thereof extends perpendicularly to said recessed cavities formed by said additional layer.

11. An apparatus for packaging a plurality of objects in a pelletless plastic foil package having cavities formed therein to receive fork arms of a lift truck, comprising a palleting device for forming a stack of layers of objects to be packaged, a first bonnet pullover device for pulling a first shrink-on foil bonnet over said stack located downstream from said palleting device, a shrinking furnace located downstream from said first bonnet pullover device for heat shrinking said first shrink-on foil bonnet onto said stack, a turnover device located downstream from said shrinking furnace for rotating said stack 180°, a second bonnet pullover device located downstream from said turnover device for pulling a second shrink-on foil bonnet over said turned over stack, a second shrinking furnace located downstream from said second bonnet pullover device for heat shrinking said second shrink-on foil bonnet onto said stack, conveyor means extending through said palleting device, said first bonnet pullover device, said first shrinking furnace, said turnover device, said second bonnet pullover device and said second shrinking furnace, and means for transporting said stack from one device to the next.

12. The apparatus according to claim 11 wherein said conveyor means comprises belt conveyors with adjoining transport rollers.

13. The apparatus according to claim 11 wherein said turnover device comprises a lower conveyor surface for supporting said stack, an uppr conveyor surface arranged above said stack, means for moving said upper and lower conveyor surfaces from opposite directions toward the stack resting on said bottom conveyor surface, means for rotating said upper and lower conveyor surfaces about a substantially central axis to effect rotation of said stack, means for subsequently moving said upper and lower conveyor surfaces away from said stack so that said upper conveyor surface will be located in the same position as said lower conveyor surface prior to said upper and lower conveyor surfaces being rotated about said axis.

14. The apparatus according to claim 13 further comprising a rotary shaft supported in bearing blocks at opposite ends thereof, bearing plates located at the inner ends of said bearing blocks, a first set of vertical guide rails carried on said bearing plates, and a second set of vertical guide rails supporting said conveyor means and which can be moved along said first set of vertical guide rails so that said upper and lower conveyor surfaces can be moved toward and away from said axis.

15. The apparatus according to claim 14 further comprising supporting plates secured to said bearing plates for supporting said stack during rotation about said axis.

16. The apparatus according to claim 11 wherein said first shrinking furnace includes pressure elements mounted for movement through a roof of said furnace for engaging said first shrink-on foil bonnet and for pressing said bonnet into the recessed cavities of said stack.

17. The apparatus according to claim 11 further comprising angle pressing tool members positioned downstream from said first shrinking furnace and mounted for movement into engagement with said recessed cavities of said stack for pressing said first shrink-on foil bonnet into said cavities.

18. The apparatus according to claim 17 wherein said pressing tool members comprise a pair of Z-shaped pressure bars mounted on a vertically adjustable beam for pivotal movement in opposite directions toward and away from said stack for positioning said angle pressing tool members in said cavities.

19. The apparatus according to claim 18 wherein said vertically adjustable beam is mounted for pivotal movement.

20. The apparatus according to claim 11 further comprising a conveyor connected to said second shrinking furnace having a length adapted to the width of said additional layer of said stack and mounted for vertical movement so that it may be lowered a distance equal to the height of said additional layer.

21. The apparatus according to claim 20 further comprising a stop bar extending transverse to the conveying direction of said conveyor and located at a front end thereof with respect to the direction of conveying, and means for lowering said stop bar below the normal conveying plane when said additional layer of said stack strikes against said stop bar.

22. The apparatus according to claim 21 further comprising a pressure plate positioned at a rear end of said conveyor with respect to the direction of conveying, and means for pivoting said pressure plate about a bottom edge thereof so as to be urged against a vertical surface of a cavity formed by said additional layer.

* * * * *